United States Patent [19]

Takashina et al.

[11] 3,941,623

[45] Mar. 2, 1976

[54] METHOD FOR PRODUCING A GRAIN-ORIENTED ELECTRICAL STEEL SHEET USING SEPARATORS COMPRISING METAL NITRIDES

[75] Inventors: Kikuo Takashina; Minoru Kitayama; Motoharu Nakamura; Yozo Suga; Kiyoshi Tanaka, all of Himeji, Japan

[73] Assignee: Nippon Steel Corporation, Tokyo, Japan

[22] Filed: Aug. 23, 1974

[21] Appl. No.: 500,079

[30] Foreign Application Priority Data

Aug. 28, 1973 Japan ..... 48-96392

[52] U.S. Cl. ..... 148/113; 148/27; 148/31.5; 148/112

[51] Int. Cl.[2] ..... H01F 1/04

[58] Field of Search ..... 148/113, 122, 31.5, 31.55, 148/111, 112, 27; 427/126, 127

[56] References Cited

UNITED STATES PATENTS

| | | | |
|---|---|---|---|
| 2,528,216 | 10/1950 | Dunn et al. | 148/113 |
| 3,632,456 | 1/1972 | Sakakura | 148/111 |
| 3,697,322 | 10/1972 | Lee et al. | 148/112 |
| 3,700,506 | 10/1972 | Tanaka et al. | 148/111 |

*Primary Examiner*—Walter R. Satterfield
*Attorney, Agent, or Firm*—Toren, McGeady and Stanger

[57] ABSTRACT

Method for producing a grain-oriented electrical steel sheet or strip having uniform magnetic and film properties said method comprising applying an annealing separator containing one or more metal nitrides, such as, chromium nitride, titanium nitride and vanadium nitride to the steel sheet and annealing the steel sheet at a temperature not lower than 1,100°C.

2 Claims, 4 Drawing Figures

UPPER

MIDDLE

LOWER

TYPICAL GRAIN STRUCTURE (x 1/1)

TYPICAL GRAIN STRUCTURE (x 1/1)

METHOD FOR PRODUCING A GRAIN-ORIENTED ELECTRICAL STEEL SHEET USING SEPARATORS COMPRISING METAL NITRIDES

The present invention relates to a method for producing a grain-oriented electrical steel, by which method steel products having no difference in the magnetic properties in the lengthwise and widthwise directions of the products and having a uniform and excellent insulating film over the entire surface of the products can be obtained.

As well known, the grain-oriented electrical steel sheet is produced by box-annealing a steel strip containing not more than 4.5% Si in a coil form with a finishing annealing temperature not lower than 1,100°C in order to develop the grains having the orientation (110)[001] as expressed by the Miller indices. However, when the steel sheet in a coil form is subjected to a finishing annealing at high temperature, the magnetic properties in the inner side, the center portion and the outer side of the coil vary and the film properties, such as, insulation and adhesion properties of the film are not uniform in most cases. These difficulties have caused a serious problem in the production of a grain-oriented electrical steel sheet. This problem becomes more serious when the unit weight of the coil at the time of the high temperature finishing annealing is increased. When the coil width is increased, the product properties very often vary in the widthwise direction, and the increased unit weight of the coil causes considerable hindrance to the improvement of the operating efficiency of the annealing furnace.

The present inventors have conducted various studies to clarify the causes of the differences in the magnetic properties and the film properties among the inner side portion, the center portion and the outer side portion of the coil, and have discovered that these differences are caused by the fact that the discharge rate of water present between the steel sheets varies due to the irregular heating rates at various portions of the coil, and that when the coil unit weight is increased, the irregularity of the treating rates is increased, thus causing a serious problem.

In the case of the production of a grain-oriented electrical steel sheet in a box-annealing furnace, it has been a common practice to apply one or more oxides, such as, MgO, CaO and $Al_2O_3$ suspended in water to the steel sheet as an annealing separator and dry it prior to the annealing. In this case, the moisture which remains between the steel sheets in the form of a hydroxide or free water is brought into the high temperature finishing annealing step, where it is discharged during the heating. However, the temperature varies at various portions of the coil so that the water discharge rate varies at different portions of the coil to cause differences in the dew point between the steel sheets. Thus, the degree of oxidation of the steel sheet varies at different portions in the coil to cause irregularity of the magnetic properties and the film properties.

Particularly, the difference in dew point within a temperature range from 900° to 1,050°C in which the grains having the orientation (110)[001] grow abnormally causes the irregularity in the magnetic properties, while the difference in the dew point within a temperature above 1,000°C where the insulating film is formed causes irregularity of the film properties.

As for the means for preventing the differences in the dew point caused by the irregular temperature increase, various proposals have been made such as to slow the heating rate of the coil and to heat the coil uniformly, but no satisfactory method has been established.

The present invention has succeeded in eliminating variations in the magnetic properties and the film properties different portions of the coil by adding one or more of metal nitrides, such as, chromium nitride, titanium nitride and vanadium nitride to the annealing separator composition, and thus has made it possible to increase the unit weight of the coil and increase the production efficiency.

Although the theoretical explanation why the metal nitrides, such as, chromium nitride, titanium nitride and vanadium nitride are effective for the above purpose has not yet been completely clarified, it is assumed from the thermodynamics data that part of the chromium nitride, titanium nitride, or vanadium nitride is converted into the corresponding oxide, namely, chromium oxide, titanium oxide, vanadium oxide in the temperature range from 900° to 1,050°C in which the grains having the orientation (110)[001] grow abnormally, and around 1,000°C where the insulation film is formed, so that the water present between the steel sheets is consumed and the dew point is lowered, thus resulting in reduction of the oxidation of the steel sheet, and uniform magnetic and film properties.

When the water present between the steel sheets is consumed and thus the dew point is lowered by the conversion of the metal nitrides, such as, chromium nitride, titanium nitride and vanadium nitride into the metal oxides, nitrogen is liberated. This liberated nitrogen, as disclosed in the Japanese patent publications Sho 46-937 and Sho 46-40855, is effective for stabilizing the magnetism. However, in the prior publications, the coil is heated in a nitrogen atmosphere so that the nitrogen permeation into the space between the steel sheets varies at the inner side portion, the center portion and the outer side portion of the coil, as well as in the widthwise direction of the coil, and thus the magnetic properties may often be irregular. In contrast, in the present invention, the nitrogen uniformly contacts the steel surface even when the steel is annealed in a coil form.

The present invention will be described in more details referring to the attached drawings.

Figure 1:
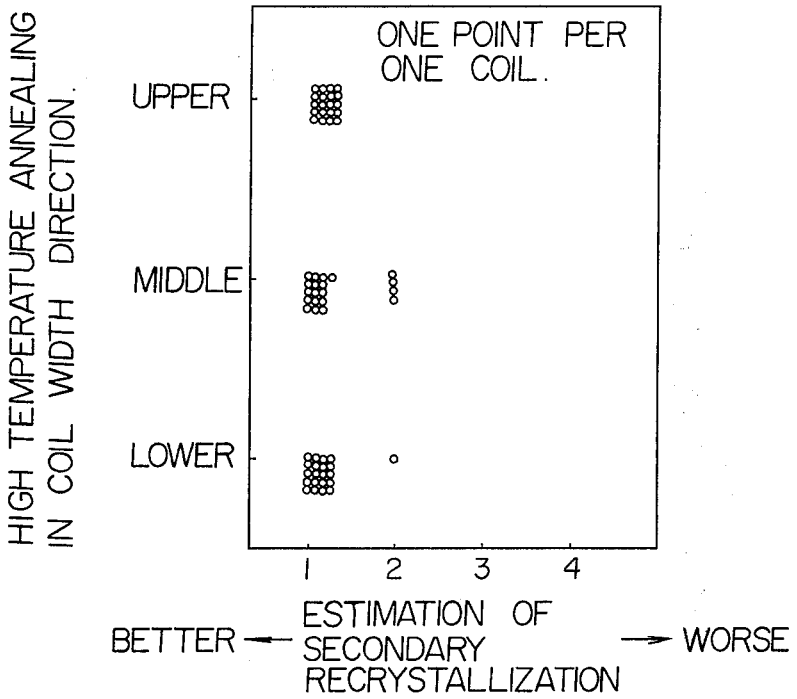
FIG. 1(*a*) is a graph showing an estimation of the secondary recrystallization in the widthwise direction of a 10 ton coil which was subjected to the high temperature finishing annealing with application of an annealing separator containing chromium nitride according to the present invention and FIG. 1(*b*) is a photograph showing a typical grain structure of the same coil.

The starting steel material to be used in the present invention may be prepared by a known process, for example, in a convertor or an electrical furnace, then made into slabs by breaking-down or continuous casting and hot rolled into hot rolled coils.

The hot rolled steel sheet used in the present invention contains not more than 4.5% Si, 0.01 to 0.050% sol.Al and not more than 0.08% C, for example, but there is no specific limitation for the components other than Si. The hot rolled coil is treated by combination of the cold rolling and the annealing into a final product thickness.

The steel sheet of the final thickness is subjected to decarburization annealing in a wet hydrogen atmosphere and an annealing separator is applied in order to prevent the burning of the steel sheet during the high-temperature annealing. As for the basic annealing separator, MgO, $Al_2O_3$ and CaO are used alone or in combination. The feature of the present invention lies in that one or more of chromium nitride, titanium nitride vanadium nitride, in powder form is added to this basic annealing separator. The desired results of the present invention can not be obtained when the addition of the metal nitrides is less than 0.5 part by weight to 100 parts of the basic separator, and on the other hand no special result is obtained even when the metal nitrides are added in an amount beyond 20 parts by weight, and result only in increased cost of the powders.

A preferable range of the addition of the metal oxides is 2 to 7 parts by weight to 100 parts of the annealing separator. It is not necessary that the metal nitrides be pure, and those containing, for example, nitrified ferrochromium containing impurities may be used. The added amount of chromium nitride, titanium nitride or vanadium nitride is almost the same for each of these metal nitrides. However, there is a tendency the appropriate addition slightly decreases in the written order.

The high-temperature finishing annealing should be done at a temperature for a time sufficient for developing fully the grains having the orientation (110)[001] and eliminating impurities. For this purpose, it is necessary to conduct the annealing in a hydrogen atmosphere at a temperature not lower than 1,100°C for at least 5 hours.

As for the means for improving the magnetic properties by adding special elements to the annealing separator for a high-temperature finishing annealing, Japanese patent publication Sho 46-42298 teaches boron addition, and Japanese patent publication Sho 46-42299 teaches addition of sulfur, selenium, etc. But these prior art processes are completely different from the present invention with respect to their object and the technical means. However, when these elements are added in addition to the metal nitrides of the present invention, the magnetic properties are further improved.

Although the present invention is particularly effective when applied to a grain-oriented electrical steel sheet containing Al, the present invention should not be limited thereto, but may be applied to production of grain-oriented electrical steel sheets in general.

The present invention will be more clear from the following examples.

EXAMPLE 1.

A hot rolled steel sheet containing 0.045 to 0.050% C, 3.00 to 3.10% Si, 0.020 to 0.025% S, and 0.0035 to 0.040% Al was annealed at 1,150°C for 2 minutes, cold rolled to a 0.30mm thickness, and decarburized in a wet hydrogen atmosphere at 840°C for 5 minutes. Meanwhile an annealing separator composed of MgO powder with the addition of chromium nitride powder, titanium nitride powder and vanadium nitride powder was suspended in water, and applied to the above steel sheet and dried. The steel sheet thus coated was coiled into a 10-ton coil of 1,030mm width and 20 inch inside diameter and subjected to high-temperature finishing annealing in a hydrogen atmosphere at 1,150°C for 20 hours. The results are shown in Table 1 in comparison with the results obtained by the application of MgO only.

Table 1

| Additives and their amount (part by weight) | Inner Side of Coil | | | Center of Coil | | | Outer Side of Coil | | |
|---|---|---|---|---|---|---|---|---|---|
| | $W_{17/50}$ | $B_8$ | Inter-laminar resistance ohm | $W_{17/50}$ | $B_8$ | Inter-laminar resistance ohm | $W_{17/50}$ | $B_8$ | Inter-laminar resistance ohm |
| (Comparative) | 1.32 | 1.88 | 10 | 1.30 | 1.89 | 5 | 1.21 | 1.90 | ∞ |
| 0.3 part chromium nitride | 1.29 | 1.89 | 20 | 1.30 | 1.89 | 10 | 1.19 | 1.91 | 15 |
| 5 " | 1.17 | 1.91 | 50 | 1.18 | 1.91 | 50 | 1.12 | 1.92 | ∞ |
| 25 " | 1.18 | 1.91 | ∞ | 1.13 | 1.92 | ∞ | 1.13 | 1.92 | ∞ |
| 0.3 part titanium nitride | 1.28 | 1.89 | 50 | 1.29 | 1.89 | 20 | 1.20 | 1.90 | 20 |
| 5 " | 1.11 | 1.92 | ∞ | 1.19 | 1.91 | ∞ | 1.13 | 1.92 | ∞ |
| 25 " | 1.20 | 1.91 | ∞ | 1.19 | 1.91 | ∞ | 1.18 | 1.91 | ∞ |
| 0.3 part vanadium nitride | 1.30 | 1.88 | ∞ | 1.31 | 1.88 | 20 | 1.21 | 1.90 | ∞ |
| 5 " | 1.18 | 1.91 | ∞ | 1.13 | 1.92 | ∞ | 1.17 | 1.91 | ∞ |
| 25 " | 1.17 | 1.91 | ∞ | 1.18 | 1.91 | ∞ | 1.10 | 1.92 | ∞ |

As clearly understood from the results shown in Table 1, the uniformity of the magnetic and film properties among the inner side portion, the center portion and the outer side portion of the coil is remarkably improved by the addition of chromium nitride, titanium nitride and vanadium nitride according to the present invention, as compared with the comparative.

EXAMPLE 2.

A hot rolled steel sheet containing 0.045 to 0.050% C, 3.00 to 3.10% Si, 0.029 to 0.035% S, and 0.030 to 0.035% Al was annealed at 1,120°C for 2 minutes, cold rolled into a 0.30mm thickness, and decarburized in wet hydrogen at 850°C for 5 minutes. Meanwhile, an annealing separator composed of MgO powder with the addition of two or more of chromium nitride, titanium nitride and vanadium nitride was suspended in water and applied to the above steel sheet and dried. Then the steel sheet thus coated was coiled into a 10-ton coil having a 1,030mm width and 20 inch inside diameter, and subjected to a high-temperature finishing annealing in a hydrogen atmosphere at 1,150°C for 20 hours, the results are shown in Table 2 in comparison with the results obtained by application of MgO only.

Table 2

| Additives and their amount (part by weight) | Inner Side of Coil | | | Center of Coil | | | Outer Side of Coil | | |
|---|---|---|---|---|---|---|---|---|---|
| | $W_{17/50}$ | $B_8$ | Inter-laminar resistance ohm | $W_{17/50}$ | $B_8$ | Inter-laminar resistance ohm | $W_{17/50}$ | $B_8$ | Inter-laminar resistance ohm |
| (Comparative) | 1.38 | 1.87 | 10 | 1.33 | 1.88 | 10 | 1.31 | 1.89 | 20 |
| 6 part chromium nitride | 1.12 | 1.92 | ∞ | 1.17 | 1.91 | ∞ | 1.11 | 1.92 | ∞ |
| 6 part titanium nitride | 1.18 | 1.91 | ∞ | 1.17 | 1.91 | ∞ | 1.12 | 1.92 | ∞ |
| 6 part vanadium nitride | 1.21 | 1.90 | ∞ | 1.18 | 1.91 | 50 | 1.17 | 1.91 | ∞ |
| 3 part chromium nitride 3 part titanium nitride | 1.13 | 1.92 | ∞ | 1.14 | 1.92 | ∞ | 1.12 | 1.92 | ∞ |
| 3 part chromium nitride 3 part vanadiaum nitride | 1.17 | 1.91 | ∞ | 1.19 | 1.91 | ∞ | 1.16 | 1.91 | ∞ |
| 3 part vanadium nitride 3 part titanium nitride | 1.18 | 1.90 | ∞ | 1.17 | 1.91 | 50 | 1.16 | 1.91 | ∞ |

As clearly understood from the results shown in Table 2, it has been confirmed that the effect of the addition of two or more of the chromium nitride, titanium nitride and vanadium nitride is the same as that of the addition of one of the metal nitride.

Figure 2:
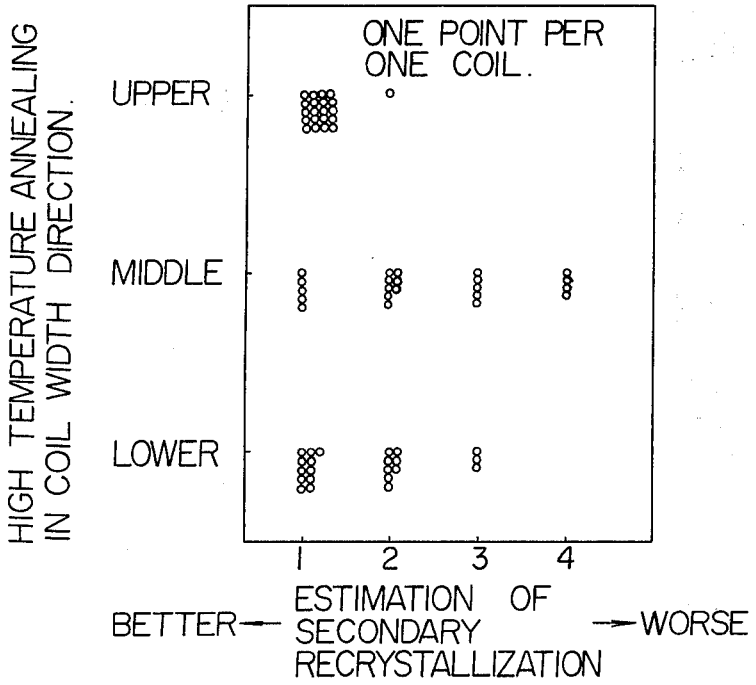
FIG. 2(*a*) is a similar graph showing an estimation of the secondary recrystallization in the widthwise direction of the coil which was annealed in a nitrogen atmosphere, and FIG. 2(*b*) is a photograph showing a typical grain structure of the same coil.
Figure 2B:
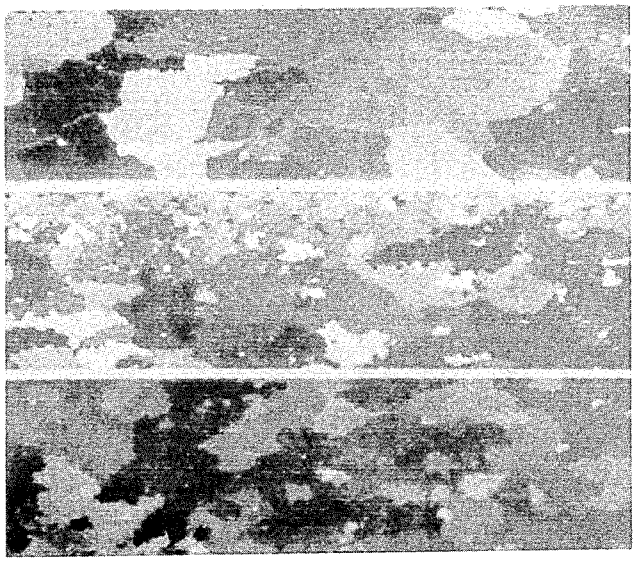
Figure 1B:
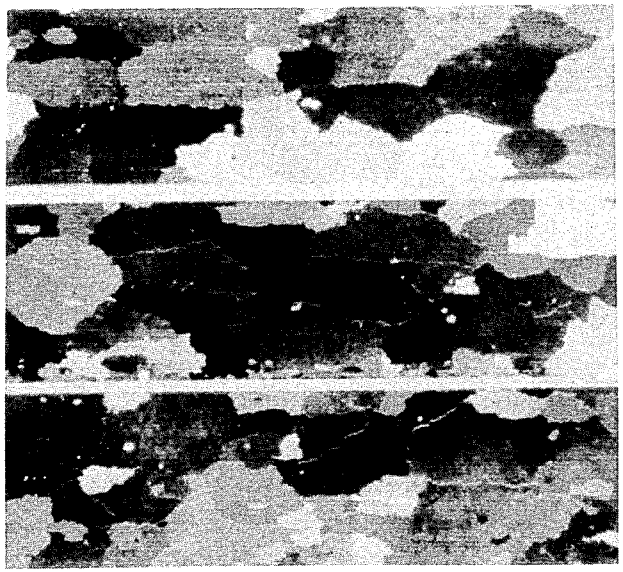

Now referring to FIG. 1 and FIG. 2, the remarkable uniformity in the widthwise direction of the coil shown in FIG. 1(*a*) and (*b*) as compared with FIG. 2(*a*) and (*b*) is due to the fact that, in the case of the nitrogen atmosphere (FIG. 2) the dew point between the steel sheets cannot be controlled and the permeation of nitrogen into the space between the steel sheets varies depending on the portions of the coil.

Also as clearly understood from FIG. 1, a very uniform secondary recrystallization in the widthwise direction of the coil is obtained by the present invention.

As described above, a highly stable grain-oriented electrical steel sheet free from variation in the magnetic and film properties all over various portions of the product can be obtained by the present invention and this result can be assured even in case of increased size of the coil, thus improving the production efficiency.

What is claimed is:

1. In a method for producing a grain-oriented electrical steel sheet having highly stabilized magnetic and film properties of the type comprising cold rolling hot rolled steel sheet containing not more than 4.5% Si into a final thickness, annealing the cold rolled sheet, applying an annealing separator to the steel sheet and subjecting the thus coated steel sheet to high-temperature annealing, the improvement which comprises said annealing separator containing one or more of metal nitrides selected from the group consisting of chromium nitride, titanium nitride, vanadium nitride, and combinations thereof in an amount not less than 0.5 part by weight to 100 parts of the annealing separator, and carrying out said annealing at a temperature not lower than 1,100°C.

2. An annealing separator useful for production of a grain-oriented electrical steel sheet which is subjected to annealing at a temperature not lower than 1,100°C, comprising a metal oxide selected from the group consisting of MgO, CaO and $Al_2O_3$ and a metal nitride selected from the group consisting of chromium, nitride, titanium nitride, vanadium nitride, and combinations thereof, said metal nitride being present in an amount not less than 0.5 part by weight to 100 parts of the metal oxide.

* * * * *